US005521618A

United States Patent [19]

Stortz et al.

[11] Patent Number: 5,521,618

[45] Date of Patent: May 28, 1996

[54] DUAL ELEMENT SWITCHED DIGITAL DRIVE SYSTEM FOR AN INK JET PRINTHEAD

[75] Inventors: James L. Stortz, Spring; David B. Wallace, Dallas, both of Tex.

[73] Assignee: Compaq Computer Corporation, Houston, Tex.

[21] Appl. No.: 60,297

[22] Filed: May 10, 1993

Related U.S. Application Data

[63] Continuation-in-part of Ser. No. 746,521, Aug. 19, 1991, Pat. No. 5,227,813.

[51] Int. Cl.[6] ..... B41J 2/045

[52] U.S. Cl. ..... 347/10; 347/69

[58] Field of Search ..... 346/1.1, 140 R; 310/316, 317; 347/9, 10, 11, 68–72

[56] References Cited

U.S. PATENT DOCUMENTS

| | | | |
|---|---|---|---|
| 3,761,741 | 9/1973 | Hoeft | 327/308 |
| 3,857,049 | 12/1974 | Zoltan | 310/8.1 |
| 4,282,535 | 8/1981 | Kern et al. | 346/140 R |
| 4,284,996 | 8/1981 | Greve | 346/140 R |
| 4,459,599 | 7/1984 | Ort | 346/140 R |
| 4,513,299 | 4/1985 | Lee et al. | 346/140 R |
| 4,514,742 | 4/1985 | suga et al. | 346/140 R |
| 4,523,200 | 6/1985 | Howkins | 346/1.1 |
| 4,523,201 | 6/1985 | Liker | 346/1.1 |
| 4,536,097 | 8/1985 | Nilsson | 400/126 |
| 4,584,590 | 4/1986 | Fischbeck et al. | 346/140 R |

(List continued on next page.)

FOREIGN PATENT DOCUMENTS

| | | | |
|---|---|---|---|
| 0364136 | 4/1990 | European Pat. Off. | B41J 2/045 |
| 0402172 | 12/1990 | European Pat. Off. | B41J 2/045 |
| 0485241 | 5/1992 | European Pat. Off. | B41J 2/045 |
| 0528647 | 8/1992 | European Pat. Off. | B41J 2/045 |
| 0548984 | 12/1992 | European Pat. Off. | B41J 2/045 |
| 3820082 | 12/1988 | Germany . | |
| 3924960 | 1/1991 | Germany . | |
| 55-65568 | 5/1980 | Japan . | |

OTHER PUBLICATIONS

Wallace, David B., entitled "A Method of Characteristic Model of a Drop–on–Demand Ink–Jet Device Using an Integral Method Drop Formation Model", *89–WA/FE–4* (1989).

Tsao, C. S., entitled "Drop–on–Demand Ink Jet Nozzle Array with Two Nozzles/Piezoelectric Crystal", *IBM Technical Disclosure Bulletin*, vol. 23 No. 10 (Mar. 1981).

*Primary Examiner*—Benjamin R. Fuller
*Assistant Examiner*—Alrick Bobb
*Attorney, Agent, or Firm*—Konneker & Bush

[57] ABSTRACT

A digital driver for an ink jet printhead and an associated method for selectively applying voltage to a piezoelectric sidewall actuator of the ink jet printhead. The digital driver includes positive and negative voltage sources, a first switching element having a first control input, a first voltage supply input connected to the positive voltage source, and a first output, and a second switching element having a second control input, a second voltage supply input connected to the negative voltage source, and a second output connected to the first output to provide a single output connected to the piezoelectric sidewall actuator. By asserting the first control input for a first time period, the first switching element generates a positive voltage pulse at the single output to displace the sidewall actuator from a rest position to a first position. Next, by simultaneously deasserting the first control input and asserting the second control input, the second switching element generates a negative voltage pulse at the single output to displace the sidewall actuator from the first position, past the rest position, to a second position. Next, by deasserting the second control input, the sidewall actuator passively returns to the rest position. The return to the rest position may be assisted by discharging the printhead after deassertion of the second control input, by re-applying the first voltage for a second, shorter, time period to actively drive the sidewall actuator towards the rest position, or by both.

18 Claims, 3 Drawing Sheets

U.S. PATENT DOCUMENTS

| | | | |
|---|---|---|---|
| 4,675,693 | 6/1987 | Yano et al. | 346/1.1 |
| 4,717,927 | 1/1988 | Sato | 346/140 R |
| 4,743,924 | 5/1988 | Scardovi | 346/140 R |
| 4,752,790 | 6/1988 | Scardovi | 346/140 R |
| 4,795,917 | 1/1989 | Scott et al. | 307/270 |
| 4,825,227 | 4/1989 | Fischbeck | 346/1.1 |
| 4,879,568 | 11/1989 | Bartky et al. | 346/140 R |
| 4,887,100 | 12/1989 | Michaelis et al. | 346/140 R |
| 4,931,810 | 6/1990 | Iwata et al. | 346/1.1 |
| 4,963,882 | 10/1990 | Hickman | 346/1.1 |
| 5,016,028 | 5/1991 | Temple | 346/140 R |
| 5,138,333 | 8/1992 | Bartky et al. | 346/1.1 |
| 5,227,813 | 7/1983 | Pies et al. | 346/140 R |
| 5,248,998 | 9/1993 | Ochiai et al. | 346/140 R |
| 5,252,994 | 10/1993 | Narita et al. | 346/140 R |

DUAL ELEMENT SWITCHED DIGITAL DRIVE SYSTEM FOR AN INK JET PRINTHEAD

CROSS REFERENCE TO RELATED APPLICATIONS

This application is a Continuation-in-Part of U.S. patent application Ser. No. 07/746,521 filed Aug. 16, 1991 now U.S. Pat. No. 5,227,813, entitled "Sidewall Actuator For A High Density Ink Jet Printhead", assigned to the Assignee of the present application, and hereby incorporated by reference as if reproduced in its entirety.

This application is also related to the following co-pending patent applications:

| Ser. No. | First Named Inventor | Title |
|---|---|---|
| 08/060,440 | Stortz | Spot Size Modulatable Ink Jet Printhead |
| U.S. Pat. No. 5436648 08/060,295 | Stortz | Switched Digital Drive System For An Ink Jet Printhead |
| U.S. Pat. No. 5444467 08/060,296 | Stortz | Differential Drive System For An Ink Jet Printhead |
| U.S. Pat. No. 5461403 08/060,294 | Wallace | Droplet Volume Modulation Techniques For Ink Jet Printheads |
| U.S. Pat. No. 5426455 08/260,298 | Williamson | Three Element Switched Digital Drive System For An Ink Jet Printhead |

All of the above listed applications were filed on even date herewith, assigned to the Assignee of the present invention, and hereby incorporated by reference as if reproduced in its entirety.

BACKGROUND OF THE INVENTION

1. Field of the Invention

The present invention generally relates to ink jet printhead apparatus and, more particularly, to a dual element switched digital drive system for piezoelectrically driving an ink jet printhead.

2. Description of Related Art

A piezoelectrically actuated ink jet printhead is a relatively small device used to selectively eject tiny ink droplets onto a paper sheet operatively fed through a printer, in which the printhead is incorporated, to thereby form from the ejected ink droplets selected text and/or graphics on the sheet. In one representative configuration thereof, an ink jet printhead has a horizontally spaced parallel array of internal ink-receiving channels. These internal channels are covered at their front ends by a plate member through which a spaced series of small ink discharge orifices are formed. Each channel opens outwardly through a different one of the spaced orifices.

A spaced series of internal piezoelectric wall portions of the printhead body separate and laterally bound the channels along their lengths. To eject an ink droplet through a selected one of the discharge orifices, the two printhead sidewall portions that laterally bound the channel associated with the selected orifice are piezoelectrically deflected into the channel and then returned to their normal undeflected positions. The driven inward deflection of the opposite channel wall portions increases the pressure of the ink within the channel sufficiently to force a small quantity of ink, in droplet form, outwardly through the discharge orifice.

According to a recently proposed drive method for this type of ink jet printhead, top sides of the internal channel dividing wall portions are commonly connected to ground, and the bottom sides of the wall portions are individually connected to a series of electrical actuating leads. Each of these leads, in turn, is connected to a drive system operable to selectively impart to the lead an electrical waveform that sequentially changes (1) from ground to a first driving polarity, (2) from the first polarity to the opposite polarity, and (3) from the opposite polarity back to ground.

When this electrical waveform is imparted to a piezoelectric channel wall portion bounding one side of a selected, and a second electrical waveform of opposite polarity sequence is simultaneously imparted (via another one of the actuating leads) to the opposite piezoelectric channel wall portion, the opposite channel wall portions, by piezoelectrical action, are sequentially deflected (1) outwardly away from the channel that they laterally bound, (2) into the channel to discharge an ink droplet therefrom, and (3) back to their starting or "neutral" positions.

Both analog and digital type drive systems have been suggested for providing the above drive method in an ink jet printhead. As analog type drive systems which utilize analog circuitry, for example, operational amplifiers (or "op-amps"), to deliver the desired electrical waveform to the ink jet printhead are linear in nature, however, such drive systems tend to produce unacceptably high levels of power dissipation and have, therefore, proven inefficient in use. Furthermore, such analog type drive systems require excessive space on the printhead, thereby adversely affecting driver density for the printhead.

Proposed digital type drive systems, on the other hand, while avoiding the aforementioned deficiencies relating to power dissipation, also have several built-in limitations and disadvantages. More specifically, such digital type drive systems utilize switching type circuits, also referred to as "digital drivers". Since the proposed drive method requires a bipolar voltage waveform with an active return to ground, digital type drive systems have heretofore required three separate drivers—one for each of the three channel wall drive portions described above. This requirement substantially increases the complexity of the drive system, thereby undesirably increasing its overall cost. Additionally, it undesirably increases the overall space requirement for the drive system.

It can be readily seen from the foregoing that it would be desirable to provide an improved ink jet printhead drive system that eliminates, or at least substantially reduces, the above-mentioned limitations and disadvantages associated with the drive systems described above. It is accordingly an object of the present invention to provide such an improved ink jet printhead drive system.

SUMMARY OF THE INVENTION

In various embodiments thereof, the present invention is of a digital driver for selectively applying voltage to a piezoelectric sidewall actuator to cause the selective deflection of the actuator to impart pressure pulses into first and second channels of an ink jet printhead and an ink jet printhead incorporating the same. The digital driver includes a first switching element having a first control input, a first voltage supply input for connection to a positive voltage source, and a first output, and a second switching element having a second switching element having a second control input, a second voltage supply input for connection to a negative voltage source, and a second output connected to the first output to provide a single output for connection to a piezoelectric sidewall actuator of an ink jet printhead. In response to an assertion of the first control input, the first switching element generates a positive voltage pulse at the single output and, in response to an assertion of the second control input, the second switching element generates a negative voltage pulse at the single output.

In further embodiments thereof, the present invention is of a digital driver, and associated methods, for selectively applying voltage to a piezoelectric sidewall actuator to cause the selective deflection of the actuator to impart pressure pulses into first and second channels of an ink jet printhead. The digital driver includes a positive voltage source, a negative voltage source, a first switching element having a first control input, a first voltage supply input connected to the positive voltage source, and a first output, and a second switching element having a second control input, a second voltage supply input connected to the negative voltage source, and a second output connected to the first output to provide a single output for connection to a piezoelectric sidewall actuator of an ink jet printhead. By asserting the first control input, the first switching element generates a positive voltage pulse at the single output to displace, in a first direction, the sidewall actuator from a rest position to a first position. Next, by simultaneously deasserting the first control input and asserting the second control input, the second switching element generates a negative voltage pulse at the single output to displace, in a second direction, the sidewall actuator from the first position, past the rest position, to a second position. Finally, by deasserting the second control input, the sidewall actuator passively returns to the rest position. In further aspects of these embodiments of the invention, the return to ground from the second position may be assisted by discharging the printhead after deassertion of the second control input by connecting a resistor between the single output and ground or by re-applying the first voltage to the sidewall actuator to actively drive the sidewall actuator towards the rest position. In further aspects of these embodiments of the invention, the first voltage is applied for a first time period, re-applied for a second, shorter time period and may be removed before the sidewall actuator reaches the rest position.

The switched digital drive system of the invention provides several advantages over prior digital type printhead drive systems that require three separate drivers—one for each of the three sidewall movement segments described above. For example, the digital drive system of the present invention requires only two drivers. Additionally, the digital drive system is considerably less complex and is thus less expensive. Moreover, the digital drive system requires appreciably less space, thereby permitting driver density, i.e., the number of drivers which may be provided in a unit of area, to be increased dramatically.

DETAILED DESCRIPTION

Figure 1:
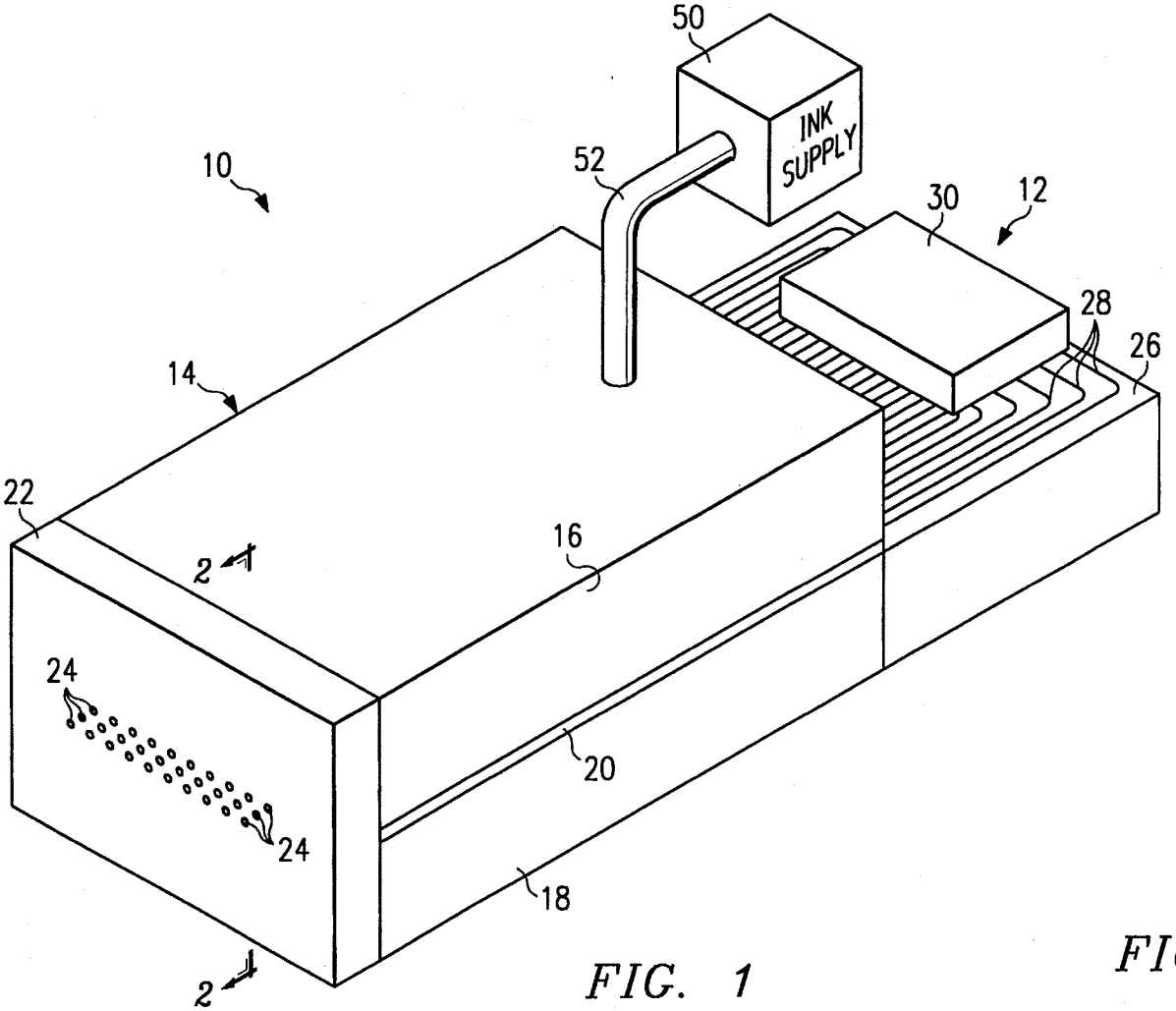
FIG. 1 is a simplified, somewhat schematic perspective view of an ink jet printhead incorporating therein a specially designed dual element switched digital drive system constructed in accordance with the teachings of the present invention.
Figure 2:
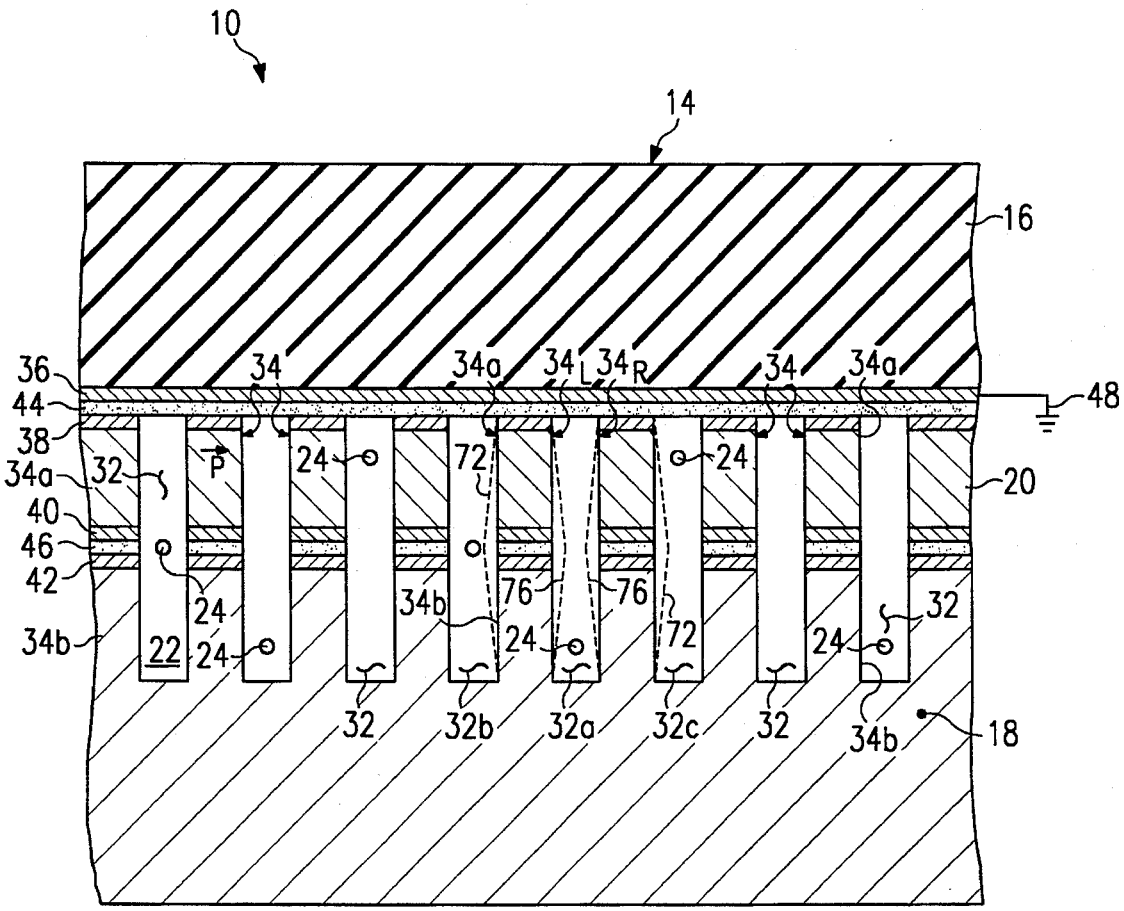
FIG. 2 is an enlarged scale partial cross-sectional view through the printhead taken along line 2—2 of FIG. 1.

Referring now to the drawing where like reference numerals designate the same or similar elements throughout the several views, in FIGS. 1 and 2, an ink jet printhead 10 incorporating therein a specially designed dual element switched digital drive system 12 constructed in accordance with the teachings of the present invention may now be seen. The ink jet printhead 10 has a body 14 having upper and lower rectangular portions 16 and 18, with an intermediate rectangular body portion 20 secured between the upper and lower portions 16 and 18 in the indicated aligned relationship therewith. A front end section of the body 14 is defined by an orifice plate member 22 having a spaced series of small ink discharge orifices 24 extending rearwardly therethrough. As shown, the orifices 24 are arranged in horizontally sloped rows of three orifices each.

In a left-to-right direction as viewed in FIG. 1, the printhead body portions 16,20 are shorter than the body portion 18, thereby leaving a top rear surface portion 26 of the lower printhead body portion 18 exposed. For purposes later described, a spaced series of electrical actuation leads 28 are suitably formed on the exposed surface 26 and extend between the underside of the intermediate body portion 20 and a controller portion 30 of the dual element switched digital drive system 12 mounted on the surface 26 near the rear end of the body portion 18.

Referring now to FIG. 2, a plurality of vertical grooves of predetermined width and depth are formed in the printhead body portions 18 and 20 to define within the printhead body 14 a spaced, parallel series of internal ink receiving channels 32 that longitudinally extend rearwardly from the orifice plate 22 and open at their front ends outwardly through the orifices 24. The channels 32 are laterally bounded along their lengths by opposed pairs of a series of internal actuation sidewall sections 34 of the printhead body.

Sidewall sections 34 have upper parts 34*a* defined by horizontally separated vertical sections of the body portion 20, and lower parts 34*b* defined by horizontally separated sections of the body portion 18. The underside of the body portion 16, the top and bottom sides of the actuation sidewall section parts 34*a*, and the top sides of the actuation sidewall section parts 34*b* are respectively coated with electrically conductive metal layers 36, 38,40 and 42.

Body portions 16 and 20 are secured to one another by a layer of electrically conductive adhesive material 44 positioned between the metal layers 36 and 38, and the upper and lower actuator parts 34*a* and 34*b* are intersecured by layers of electrically conductive material 46 positioned between the metal layers 40 and 42. The metal layer 36 on the underside of the upper printhead body portion 16 is connected to ground 48. Accordingly, the top sides of the upper actuator parts 34*a* are electrically coupled to one another and to ground 48 via the metal layers 38, the conductive adhesive layer 44 and the metal layer 36.

Each of the channels 32 is filled with ink received from a suitable ink supply reservoir 50 (see FIG. 1) connected to the channels via an ink delivery conduit 52 connected to an ink supply manifold (not shown) disposed within the printhead body 14 and coupled to rear end portions of the internal channels 32. In a manner subsequently described, each horizontally opposed pair of the sidewall actuators 34 is piezoelectrically deflectable into and out of their associated channel 32, under the control of the dual element switched digital drive system 12, to force ink (in droplet form) outwardly through the orifice 24 associated with the actuated channel.

Figure 3A:
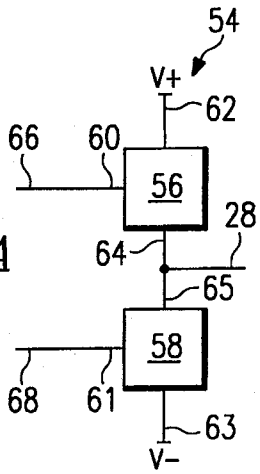
FIG. 3A is a schematic wiring diagram of a dual element switched digital drive system incorporated into the ink jet printhead of FIG. 1.

Referring now to FIGS. 1 and 3A, as previously mentioned, the dual element switched digital drive system 12 includes the controller 30 which is operatively connected to rear ends of the electrical actuation leads 28. The front ends of the leads 28 are individually connected to the metal layers 40 (see FIG. 2) on the undersides of the top sidewall actuator parts 34*a*. Within the controller 30 are a series of switching structures 54 each of which is connected to one of the leads 28 as schematically depicted in FIG. 3A.

Each switching structure 54 includes first and second switching elements 56, 58. It is contemplated that various switching circuits, for example, a bipolar transistor or a field effect transistor, are suitable for use as the switching elements 56, 58. The first switching element 56 has a control input line 60 connected to a first (or "drive_pos") drive signal 66, a supply voltage input line 62 connected to a positive DC voltage source and an output line 64 connected to lead 28. Similarly, the second switching element 58 has a control input line 61 connected to a second (or "drive_neg") drive signal 68, a supply voltage input line 63 connected to a negative DC voltage source and an output line 65 connected to lead 28. In operation, the first drive signal 66 is asserted during a first time interval to produce a positive pulse as the output at lead 28 which would drive a piezoelectric sidewall actuator 34 electrically associated therewith, from a rest position, in a first direction, thereby imparting a compressive pressure pulse to a first ink-carrying channel 32 partially defined by the sidewall actuator 34 being driven by the switching structure 54 and an expansive pressure pulse to a second ink-carrying channel 32 partially defined by the sidewall actuator 34 being driven by the switching structure 54.

Next, during a second time interval, the first drive signal 66 is deasserted and the second drive signal 68 is simultaneously asserted, thereby causing the output at lead 28 to transition from positive to negative, thereby driving the piezoelectrical sidewall actuator 34 electrically associated therewith in the opposite direction, thereby imparting a compressive pressure pulse to the second ink-carrying channel 32 partially defined by the sidewall actuator 34 being driven by the switching structure 54 and an expansive pressure pulse to the first ink-carrying channel 32 partially defined by the sidewall actuator 34 being driven by the switching structure 54. Finally, during a third time interval, the second drive signal 68 is deasserted while the first drive signal 66 remains deasserted. In response thereto, the output at lead 28 of the switching structure 54 will passively return to ground, thereby allowing the sidewall actuator 34 driven by the switching structure 54 to return to its rest position. While the output at lead 28 will passively return to ground over time, it is contemplated, however, that the switching structure 54 may be modified to speed the passive return of the sidewall actuator 34 to its rest position. Alternately, or in combination therewith, the drive signals 66 and/or 68 may be used in various drive methods during the third time interval to actively drive the output to ground. One such drive method is disclosed below. Another is described in co-pending U.S. patent application Ser. No. 08/060,295 filed simultaneously herewith and previously incorporated by reference as if reproduced in its entirety.

With respect to each of the dual switching elements 56, 58, the controller 30 is operative to selectively transmit the drive_pos control signal 66 to the control input 60 of the switching element 56, or the drive_neg control signal 68 to the control input 61 of the second switching element 58. Receipt of the drive_pos control signal 66 by the switching structure 54 creates a positive DC voltage in its associated electrical actuation lead 28, while receipt of the drive_neg control signal 68 by the switching structure 54 creates a negative DC voltage in the lead 28. Via the lead 28, this positive or negative DC voltage is transmitted to the upper actuation sidewall portion metal layer 40 to which the lead is operatively connected.

Using the dual element switched digital drive system 12 of the present invention a selected one or more of the ink receiving channels 32 may be actuated to drive a quantity of ink therein, in droplet form, outwardly through the associated ink discharge orifice(s) 24. To illustrate the operation of the dual element switched digital drive system 12, the actuation of a representative channel 32*a* will be described shortly in conjunction with FIGS. 2 and 4.

Figure 3B:
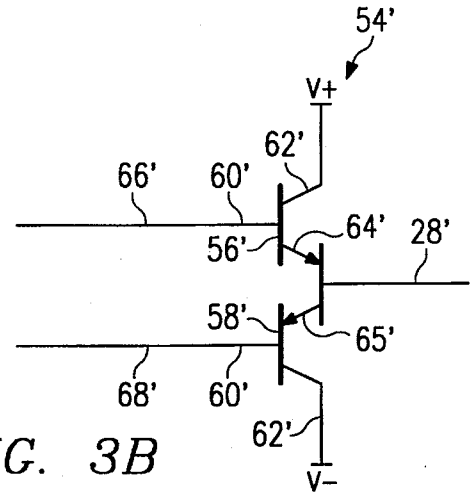
FIG. 3B is a schematic wiring diagram of a specific embodiment of the dual element switched digital drive system of FIG. 3A.

Referring now to FIG. 3B, a specific embodiment of the switching structure 54 will now be described in greater detail. In this embodiment, each switching element 54' includes a pair of transistors 56' and 58', each having a base portion 60', a collector portion 62', and an emitter portion 64'. As illustrated, the collector portion 62' of transistor 56' is connected to a positive DC voltage source and the collector portion 62' of transistor 58' is connected to a negative DC voltage source. As further illustrated, the emitter portion 64' of transistor 56' and the emitter portion 64' of transistor 58' are connected to the lead 28'.

With respect to each of the dual transistor switches 54', the controller 30 is operative to selectively transmit a first (or "drive_pos") control signal 66' to the base portion 60' of the transistor 56', or a second (or "drive_neg") control signal 68' to the base portion 60' of the transistor 58'. Receipt of the drive_pos control signal 66' by the switching structure 54' creates a positive DC voltage in its associated electrical actuation lead 28', while receipt of the drive_neg control signal 68' by the switching structure 54' creates a negative DC voltage in the lead 28'. Via the lead 28', this positive or negative DC voltage is transmitted to the upper actuation sidewall portion metal layer 40 to which the lead is operatively connected.

Figure 4:
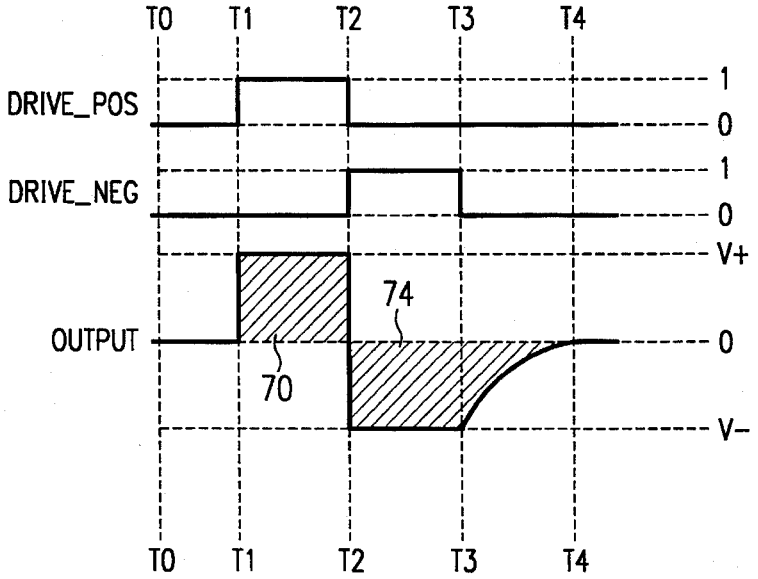
FIG. 4 is a timing diagram illustrating a representative actuation sequence of one of the dual switching elements of the digital drive system of FIG. 3A.

Referring now to FIGS. 2 and 4, the operation of the dual element switched digital drive system 12 incorporating a switching circuit 54 such as that illustrated in FIG. 3A, will now be described. Prior to the actuation of the channel 32*a*, its horizontally opposed left and right sidewall actuators $34_L$ and $34_R$ are (at time $T_o$ in FIG. 4) in initial, laterally undeflected (or "rest") positions indicated by solid lines in FIG. 2. To initiate the channel actuation cycle, the switching structure 54 associated with the left sidewall actuator $34_L$ is operated to impose thereon a constant positive DC voltage pulse 70 during the time interval $T_1$–$T_2$ shown in FIG. 4. Simultaneously, the switching structure 54 associated with the right sidewall actuator $34_R$ is operated to impose thereon an equal constant negative DC voltage pulse during the time interval $T_1$–$T_2$. These opposite polarity DC voltage pulses transmitted to the sidewall actuators $34_L$ and $34_R$ outwardly deflect them away from the channel 32*a* being actuated and into the outwardly adjacent channels 32*b* and 32*c* as indicated by the dotted lines 72 in FIG. 2, thereby imparting respective compressive pressure pulses to the channels 32*b* and 32*c* and expansive pressure pulses to the channel 32*a*.

To cause the sidewall actuator $34_L$ to deflect in this manner, at time $T_1$, the drive_pos control input 66 is asserted, thereby causing the first switching element 56 of the switching structure 54 to generate a positive voltage pulse 70 at the output line 64. The positive voltage pulse 70 is then transmitted from the output line 64 to the sidewall actuator $34_L$ via lead 28.

Next, at time $T_2$, the positive voltage pulse 70 transmitted to sidewall actuator $34_L$ and the corresponding negative voltage pulse on the sidewall actuator $34_R$ are terminated, and the two switching structures 54 are operated to simultaneously impose a constant negative DC voltage pulse 74 on the left sidewall actuator $34_L$, while imposing an equal constant positive DC voltage pulse on actuator $34_R$, during the time interval $T_2$–$T_3$. These opposite polarity constant DC voltage pulses inwardly deflect the sidewall actuators $34_L$ and $34_R$ past their initial undeflected positions and into the channel 32*a* as indicated by the dotted lines 76 in FIG. 2, thereby simultaneously imparting respective compressive pressure pulses into the channel 32*a*. Such inward deflection of the actuators $34_L$ and $34_R$ reduces the volume of channel 32*a*, thereby elevating the pressure of ink therein to an extent sufficient to force a quantity of the ink, in droplet form, outwardly through the orifice 24 associated with the actuated channel 32*a*.

To cause the sidewall actuator $34_L$ to deflect in this manner, at time $T_2$, the drive_pos control input 66 is deasserted and the drive_neg control input 68 is asserted, thereby causing the first switching element 56 of the switching structure 54 to terminate of the positive voltage pulse 70 and causing the second switching element 58 of the switching structure 54 to generate the negative voltage pulse 74 at the output line 65. The negative voltage pulse 74 is then transmitted from the output line 65 to the sidewall actuator $34_L$ via the lead 28.

Next, at time $T_3$, the negative voltage pulse 74 applied to sidewall actuator $34_L$ and the corresponding positive voltage pulse applied to the sidewall actuator $34_R$ are terminated, and the switching structures 54 are operated to simultaneously allow the sidewall actuators $34_L$ and $34_R$ to return to their respective rest positions by allowing the, prior to time $T_3$, constant negative DC voltage pulse 74 applied across the left sidewall actuator $34_L$ and the equal, prior to time $T_3$, constant positive DC voltage pulse across the sidewall actuator $34_R$ to gradually return to ground during the time interval $T_3$–$T_4$ as illustrated in FIG. 4. As these opposite polarity voltages across the sidewall actuators $34_L$ and $34_R$ gradually return to ground, the amount of deflection of the sidewall actuators $34_L$ and $34_R$ into the channel 32*a* produced in response thereto gradually lessens, thereby permitting the passive return of the sidewall actuators $34_L$ and $34_R$ to their respective rest positions.

To cause the sidewall actuator $34_L$ to return to its rest position in this manner, at time $T_3$, the drive_neg control input 68 is deasserted while the drive_pos control input 66 remains deasserted. In the absence of a control input 66, 68 to either of the switching elements 56, 58 of the switching structure 54, the output voltage at lead 28 gradually drops, thereby gradually reducing the extent of the deflection of the sidewall actuator $34_L$ from the rest position into the channel 32*a* until the sidewall actuator $34_L$ returns to the rest position. The exact time period ($T_4$–$T_3$) required for the sidewall actuator $34_L$ to reach the rest position will be determined by the mechanical time constant of the system.

It has been acknowledged that the time period ($T_4$–$T_3$) required for the sidewall actuator $34_L$ to return to the rest position after deassertion of the drive_neg control input 68, if excessively long in duration, may unacceptably limit the upper frequency of operation of the ink jet printhead 10, i.e., how often the channels of the ink jet printhead 10 may be fired, to unacceptably low levels. Accordingly, an alternate embodiment of the invention which will assist in the alleviation of this potential problem by significantly reducing the time period ($T_4$–$T_3$) required for a sidewall actuator to return to the rest position will now be described in greater detail with respect to FIG. 5.

Figure 6:
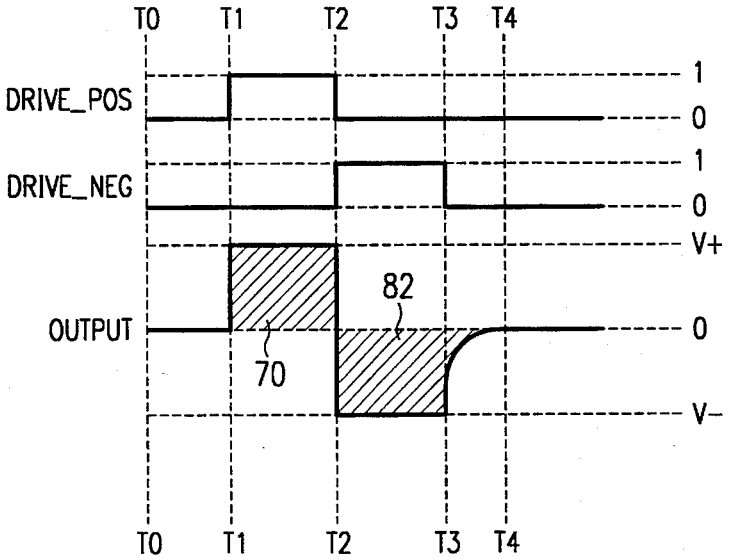
FIG. 6 is a timing diagram illustrating a representative actuation sequence of one of the dual switching elements of the digital drive system of FIG. 5 operating in a first drive method.

In this embodiment of the dual element switched digital driver 12, switching structure 78 has been modified by the installation of a resistor 80 between output 28 and ground. The resistor 80 provides a discharge path to ground for the output voltage at lead 28 of the switching structure 78. Upon deassertion of the drive_neg control input 68, while the drive_pos control input 66 remains deasserted, the time period ($T_4$–$T_3$) for the output voltage at lead 28 of the switching circuit 54 to return to ground will be significantly shortened by the discharge of the output voltage by the resistor 80. The faster discharge of the output voltage at lead 28 may be seen by reference to FIG. 6. As may now be seen, after the drive_neg control input 68 has been deasserted at time $T_3$, the time period ($T_4$–$T_3$) for the, prior to time $T_3$, constant negative DC voltage pulse 82 to return to ground has been shortened dramatically by the discharge path provided by the resistor 80.

Figure 5:
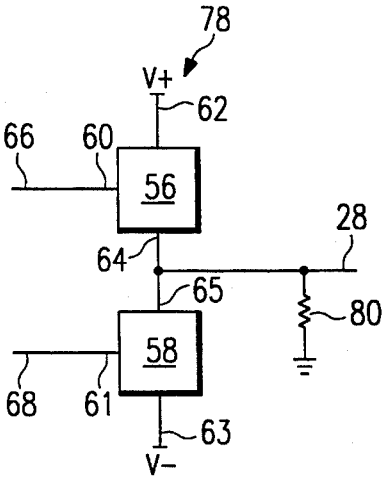
FIG. 5 is a schematic wiring diagram of an alternate embodiment of the dual element switched digital drive system of FIG. 3A.
Figure 7:
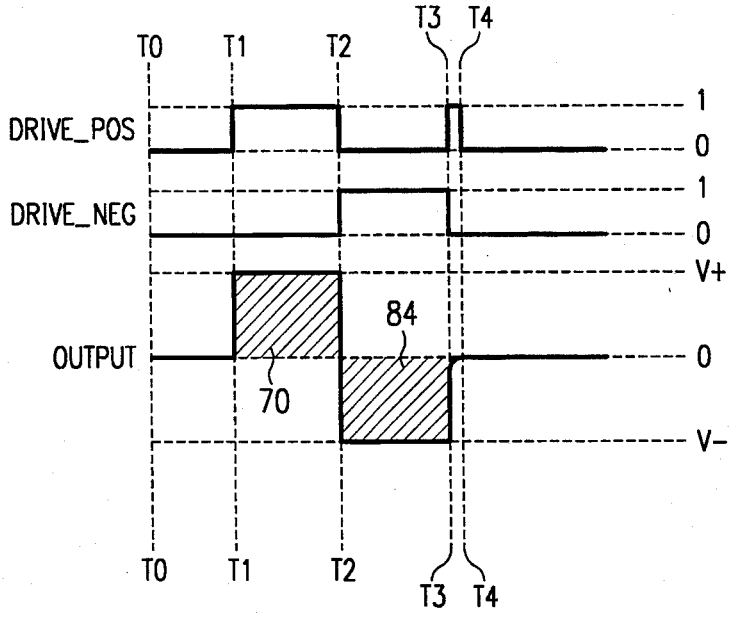
FIG. 7 is a timing diagram illustrating a representative actuation sequence of one of the dual switching elements of the digital drive system of FIG. 5 operating in a second drive method.

Referring next to FIG. 7, a drive method suitable for use in conjunction with either the switching structure 54 of FIG. 3A or the switching structure 78 of FIG. 5 for the purpose of further reducing the time period ($T_4$–$T_3$) required for the sidewall actuator $34_L$ to return to the rest position after deassertion of the drive_neg control input 68, thereby further improving the upper frequency limit for operation of the ink jet printhead 10, will now be described. In accordance with this drive method, after the drive_neg control input 68 has been deasserted, the drive_pos control input 66 is reasserted for a second time period ($T_4$–$T_3$) substantially shorter that the first time period ($T_2$–$T_1$) during which the drive_pos control input 66 was originally asserted. The drive_pos control input 66 is then deasserted before the sidewall actuator $34_L$ reaches the rest position. By reasserting the drive_pos control input 66, the, prior to time $T_3$, constant negative output voltage pulse 84 at lead 28 is actively driven towards ground, again shortening the time period for the sidewall actuator to return to the rest position after deassertion of the drive_neg control input 68. If desired, sensing means (not shown) for determining the output voltage 82 at lead 28 may be used to control the deassertion of the re-asserted drive_pos control input 66 when output voltage 82 reaches ground.

Compared to other analog or digital drive systems used to actuate selectively variable internal ink receiving channels in an ink jet printhead, the switched digital drive system 12 of the present invention provides several desirable advantages. For example, other digital drive systems typically require three separate drivers—i.e., (1) a ground-to-positive driver, (2) a positive-to-negative driver, and (3) a negative-to-ground driver. In contrast to this three driver requirement, the digital drive system 12 subject of the present invention requires only two drivers. This reduction in the number of drivers required substantially reduces the complexity of the drive system. In turn, this materially lessens the overall cost of the drive system. Additionally, the reduced driver requirement advantageously reduces the overall space requirement for the drive system. Likewise, when compared to analog drive systems, the disclosed digital drive system has achieved a significant reduction in space requirements.

The foregoing detailed description is to be clearly understood as being given by way of illustration and example only, the spirit and scope of the present invention being limited solely by the appended claims.

What is claimed is:

1. A digital driver for selectively applying voltage to a piezoelectric sidewall actuator to cause a selective deflection of said actuator to impart pressure pulses into first and second channels of an ink jet printhead, comprising:

a first switching element having a first control input, a first voltage supply input for connection to a positive voltage source and a first output, said first switching element generating a positive voltage pulse at said first output in response to assertion of said first control input, said first switching element being comprised of a first transistor having a base connected to said first control input, a collector connected to said first voltage supply input, and an emitter connected to said first output; and a second switching element having a second control input, a second voltage supply input for connection to a negative voltage source and a second output, said second switching element generating a negative voltage pulse at said second output in response to assertion of said second control input, said second switching element being comprised of a second transistor having a base connected to said second control input, an emitter connected to said second output, and a collector connected to said second voltage supply input;

said first and said second output connected to provide a single output for connection to said piezoelectric sidewall actuator of said ink jet printhead;

said positive voltage pulse being provided at said single output in response to assertion of said first control input while said second control input remains deasserted and said negative voltage pulse being subsequently provided at said single output in response to simultaneous deassertion of said first control input and assertion of said second control input.

2. A digital driver according to claim 1 and further comprising a resistor connected between said single output and ground.

3. A digital driver for selectively applying voltage to a piezoelectric sidewall actuator to cause a selective deflection of said actuator to impart pressure pulses into first and second channels of an ink jet printhead, comprising:

a positive voltage source;

a first switching element having a first control input, a first voltage supply input connected to said positive voltage source and a first output, said first switching element generating a positive voltage pulse at said first output upon assertion of said first control input, said first switching element being comprised of a first transistor having a base connected to said first control input, a collector connected to said first voltage supply input, and an emitter connected to said first output;

a negative voltage source;

a second switching element having a second control input, a second voltage supply input connected to said negative voltage source and a second output, said second switching element generating a negative voltage pulse at said second output upon assertion of said second control input, said second switching element being comprised of a second transistor having a base connected to said second control input, an emitter connected to said second output, and a collector connected to said second voltage supply input;

said first and said second output connected to provide a single output for connection to said piezoelectric sidewall actuator of said ink jet printhead;

said positive voltage pulse being provided at said single output in response to assertion of said first control input while said second control input remains deasserted and said negative voltage pulse being subsequently provided at said single output in response to simultaneous deassertion of said first control input and assertion of said second control input;

wherein, from a rest position, said sidewall actuator is displaced, in a first direction, to a first position by assertion of said first control input and, from said first position, said sidewall actuator is displaced, in a second direction, past said rest position and to a second position by deassertion of said first control input and assertion of said second control input, said sidewall actuator returning to said rest position upon deassertion of said second control input.

4. A digital driver according to claim 3 and further comprising means for discharging said printhead after deassertion of said second control input, thereby speeding the return of said sidewall actuator to said rest position.

5. A digital driver according to claim 4 wherein said discharge means further comprises a resistor connected between said single output and ground.

6. An ink jet printhead, comprising:

a body having a front end section with a plurality of enclosed ink receiving channels each longitudinally extending rearwardly through the interior of said body and opening outwardly at said front end section, each of said channels having a lengthwise dimension and being partially bounded along said lengthwise dimension by first and second piezoelectrically deflectable actuation portions of said body; and drive means for actuating selected ones of said actuation portions, said drive means including:

a positive voltage source;

a series of first switching elements, each having a first control input, a first voltage supply input connected to said positive voltage source and a first output, each said first switching element generating a positive voltage pulse at said first output upon assertion of said first control input and comprised of a first transistor having a base connected to said first control input, a collector connected to said first voltage supply input, and an emitter connected to said first output;

a negative voltage source;

a corresponding series of second switching elements, each having a second control input, a second voltage supply input connected to said negative voltage source and a second output connected to said first output to provide a single output connected to one of said actuation portions, each said second switching element generating a negative voltage pulse at said second output upon assertion of said second control input and comprised of a second transistor having a base connected to said second control input, an emitter connected to said second output, and a collector connected to said second voltage supply input;

said positive voltage pulse provided at said single output in response to assertion of said first control input while said second control input remains deasserted and said negative voltage pulse provided at said single output in response to simultaneous deassertion of said first control input and assertion of said second control input;

wherein, from a rest position, selected ones of said actuation portions may be deflected into a first position by assertion of said first control input electrically associated therewith, thereby imparting a compressive pressure pulse into a first channel partially bounded by said actuation portion and an expansive pressure pulse into a second channel partially bounded by said actuation portion and, from said first position, said actuation portion may be deflected, in a second direction, past said rest position and to a second position by deassertion of said first control input electrically associated therewith and assertion of said second control input electrically associated therewith, thereby imparting an expansive pressure pulse into said first channel and a compressive pressure pulse into said second channel, said actuation portion returning to said rest position upon deassertion of said second control input electrically associated therewith.

7. An ink jet printhead according to claim 6 wherein said drive means further comprises means for individually discharging each of said actuation portions of said body after deassertion of said second control input electrically associated therewith, thereby speeding the return of said discharged actuation portions to said rest position.

8. An ink jet printhead according to claim 7 wherein said discharge means further comprises a corresponding series of resistors, each having a first end connected to said first and second outputs of said corresponding first and second switching elements and a second end connected to ground.

9. A method of operatively driving a piezoelectric sidewall actuator of an ink jet printhead, comprising the steps of:

applying a first voltage having a first polarity to said sidewall actuator for a first time period, to deflect said sidewall actuator, from a rest position, to a first position;

simultaneously removing said first voltage and applying a second voltage having a second, opposite, polarity to said sidewall actuator, to deflect said sidewall actuator, from said first position, past said rest position, and to a second position;

removing said second voltage to permit said sidewall actuator to discharge said second voltage and to passively return to said rest position;

re-applying said first voltage to said sidewall actuator for a second time period shorter than said first time period to actively drive said sidewall actuator towards said rest position; and removing said re-applied first voltage before said sidewall actuator reaches said rest position.

10. A method according to claim 9 wherein the step of removing said re-applied first voltage further comprises the step of accelerating the discharge of said second voltage to speed the passive return of said sidewall actuator to said rest position.

11. A method of operatively driving a piezoelectric sidewall actuator of an ink jet printhead, comprising the steps of:

providing a switching structure having first and second control inputs and an output connected to said sidewall actuator;

asserting said first control input for a first period of time, said switching structure providing a positive voltage at said output in response thereto, said positive output voltage driving said sidewall actuator from a rest position to a first position;

simultaneously deasserting said first control input and asserting said second control input, said switching structure providing a negative voltage at said output in response thereto, said negative output voltage driving said sidewall actuator from said first position, past said rest position, and to a second position;

deasserting said second control input, said negative output voltage discharging, over a period of time, in response to said deassertion of said second control input, to passively return said sidewall actuator to said rest position;

reasserting said first control input for a second time period shorter than said first time period to actively drive said sidewall actuator towards said rest position; and deasserting said reasserted first control input before said sidewall actuator reaches said rest position.

12. A method according to claim 11 wherein the step of deasserting said reasserted first control input before said sidewall actuator reaches said rest position further comprises the step of accelerating the discharge of said negative voltage to speed the passive return of said sidewall actuator to said rest position after deassertion of said reasserted first control input.

13. A method of operatively driving a piezoelectric sidewall actuator of an ink jet printhead, comprising the steps of:

applying a first voltage having a first polarity to said sidewall actuator for a first time period, to deflect said sidewall actuator, from a rest position, to a first position;

simultaneously removing said first voltage and applying a second voltage having a second, opposite, polarity to said sidewall actuator, to deflect said sidewall actuator, from said first position, past said rest position, and to a second position;

removing said second voltage to permit said sidewall actuator to discharge said second voltage and to passively return to said rest position; and re-applying said first voltage to said sidewall actuator for a second time period shorter than said first time period to actively drive said sidewall actuator towards said rest position.

14. A method according to claim 13 and further comprising the step of removing said re-applied first voltage.

15. A method according to claim 14 wherein the step of removing said re-applied first voltage further comprises the step of accelerating the discharge of said second voltage to speed the passive return of said sidewall actuator to said rest position.

16. A method of operatively driving a piezoelectric sidewall actuator of an ink jet printhead, comprising the steps of:

providing a switching structure having first and second control inputs and an output connected to said sidewall actuator;

asserting said first control input for a first period of time, said switching structure providing a positive voltage at said output in response thereto, said positive output voltage driving said sidewall actuator from a rest position to a first position;

simultaneously deasserting said first control input and asserting said second control input, said switching structure providing a negative voltage at said output in response thereto, said negative output voltage driving said sidewall actuator from said first position, past said rest position, and to a second position;

deasserting said second control input, said negative output voltage discharging, over a period of time, in response to said deassertion of said second control input, to passively return said sidewall actuator to said rest position; and reasserting said first control input for a second time period shorter than said first time period to actively drive said sidewall actuator towards said rest position.

17. A method according to claim 16 and further comprising the step of deasserting said reasserted first control input.

18. A method according to claim 17 wherein the step of deasserting said reasserted first control input further comprises the step of accelerating the discharge of said negative voltage to speed the passive return of said sidewall actuator to said rest position after deassertion of said reasserted first control input.

* * * * *